US008869321B2

(12) United States Patent
Donnelly et al.

(10) Patent No.: US 8,869,321 B2
(45) Date of Patent: Oct. 28, 2014

(54) SEAL-LESS WALL PANEL HOLDER FOR A SHOWER PAN

(75) Inventors: Steve Donnelly, Saint-Antoine-de-Tilly (CA); Pierre Alexandre Hamel, Scott (CA)

(73) Assignee: Maax Bath Inc., Montréal (CA)

( * ) Notice: Subject to any disclaimer, the term of this patent is extended or adjusted under 35 U.S.C. 154(b) by 315 days.

(21) Appl. No.: 13/030,403

(22) Filed: Feb. 18, 2011

(65) Prior Publication Data

US 2011/0203046 A1 Aug. 25, 2011

Related U.S. Application Data

(60) Provisional application No. 61/306,028, filed on Feb. 19, 2010.

(51) Int. Cl.

| | |
|---|---|
| ***A47K 3/00*** | (2006.01) |
| ***A47K 3/30*** | (2006.01) |
| ***A47K 3/40*** | (2006.01) |

(52) U.S. Cl.

CPC .... *A47K 3/30* (2013.01); *A47K 3/40* (2013.01)
USPC ..... 4/613

(58) Field of Classification Search

USPC ..... 4/612–614, 599, 600, 476–478; 248/346.5; 52/716.2, 272

See application file for complete search history.

(56) References Cited

U.S. PATENT DOCUMENTS

| | | | | |
|---|---|---|---|---|
| 1,800,562 | A * | 4/1931 | Nilson | 403/40 |
| 3,363,267 | A * | 1/1968 | Kaiser et al. | 4/613 |
| 3,462,771 | A * | 8/1969 | Moretti | 4/613 |
| 4,035,957 | A * | 7/1977 | Roloff | 49/388 |
| 4,720,876 | A * | 1/1988 | Tomei et al. | 4/614 |
| 6,363,547 | B1 * | 4/2002 | Perry | 4/614 |
| 6,990,695 | B2 * | 1/2006 | Grayson | 4/613 |
| 7,493,673 | B2 * | 2/2009 | Garrett | 16/252 |
| 2006/0277716 | A1 * | 12/2006 | Sprague | 16/252 |
| 2010/0024169 | A1 * | 2/2010 | Self | 16/354 |

FOREIGN PATENT DOCUMENTS

| | | | |
|---|---|---|---|
| DE | 3737313 | A1 * | 5/1989 |
| GB | 2271713 | A * | 4/1994 |

OTHER PUBLICATIONS ths.gardenweb.com dated Apr. 11, 2008.*

* cited by examiner

*Primary Examiner* — Huyen Le
*Assistant Examiner* — Christine Skubinna
(74) *Attorney, Agent, or Firm* — David Turgeon; Fasken Martineau DuMoulin LLP

(57) ABSTRACT

A wall panel holder for a shower pan which comprises a holding body including first and second spaced apart sidewalls. The sidewalls define a holding gap between them which is sized and shaped to permit a lower part of a wall panel to be snuggly received by it. the holding gap is located away from a perimeter wall of the shower pan so as to hold the wall panel away from the perimeter wall and to allow water to flow between the perimeter wall and under the lower part of the wall panel.

17 Claims, 6 Drawing Sheets

SEAL-LESS WALL PANEL HOLDER FOR A SHOWER PAN

CROSS REFERENCE TO RELATED APPLICATIONS

The applicants hereby claim priority from previously filed U.S. provisional patent application Ser. No. 61/306,028, filed on Feb. 19, 2010, the entire contents of which are hereby incorporated by reference.

TECHNICAL FIELD

The present concerns shower pans and more particularly to wall panel holders used in shower pans.

BACKGROUND

A dedicated shower stall is often preferred by a user compared to a shower that uses a bathtub as a base for a combined bath and shower area. The shower stall is typically located adjacent an existing wall in a bathroom or adjacent two walls in the corner of the bathroom, the latter being the more space conserving than the former.

Wall panels, which are made from glass, or transparent or semi-transparent material, can be used as one of the walls of a shower stall. The wall panels, together with a shower door, enclose the shower stall and prevent water splashing onto the floor surrounding the shower stall. Typically, a shower base, or pan, has a flat perimeter wall upper surface which is used to connect the lower part of the wall panel to the pan. The wall panel, which may be framed, sits on the perimeter surface and is fixed thereto using screws or bolts. To ensure a water-tight seal, a line of caulk is employed around the join where the wall panel is connected to the perimeter surface.

Some shower pans have been designed with a U-shaped groove located in the flat perimeter surface to permit location of the lower portion of the wall panel therein. While this design addresses some of the problems of having to mechanically fix the wall panel to the pan, it also has a number of drawbacks. Installation of the wall panel may be problematic because an adhesive is typically used to secure the wall panel in the U-shaped groove. Over time, the adhesive may deteriorate such that water leaks may occur at the joint between the wall panel and the perimeter wall which can result in water spillage outside of the shower stall. One significant disadvantage of these designs is that if water escapes to the outside of the wall panel, its return to the pan, and therefore the shower drain is prevented.

Thus there is a need for a wall panel holder that significantly reduces or essentially eliminates the problems associated with conventional wall panel holders.

The shower base, or pan, can be made of a plastic material such as polypropylene.

SUMMARY

We have designed a seal-less shower panel holder which eliminates the need to glue or to use sealant to locate the wall panel in a shower base. Gluing is no longer required using our wall panel holders because the wall panel is simply inserted into them using an interference fit. Moreover, the need for caulking is eliminated around the junction of the wall panel and the shower pan. Our shower panel holder is therefore quick and easy to install and does not require time consuming measurements and markings for location of the wall panel. Our design substantially reduces or essentially eliminates water leakage to the outside of the shower base. Furthermore, our design incorporates a reversible mechanical door fixation on base. Also, the wall panel holders are positioned to define a wall panel drainage channel between the bottom of the wall panel and the shower pan, which eliminates the need for a gasket or sealant.

Accordingly, there is provided a wall panel holder for a shower pan, comprising: a holding body including first and second spaced apart sidewalls defining a holding gap therebetween, the holding gap being sized and shaped to permit a lower portion of a wall panel to be snuggly received therein, the holding gap being located away from a perimeter wall of the shower pan so as to hold the wall panel away from the perimeter wall and to permit water to flow between the perimeter wall and under the lower portion of the wall panel.

In one example, the holding gap has a first gap axis disposed substantially parallel to the perimeter wall and a second gap axis disposed substantially orthogonal to a floor of the shower pan, the wall panel being held in the holding gap generally orthogonal to the floor along the second gap axis.

In another example, the holding body includes: first and second holding body portions, each body portion including the respective first and second sidewalls, the sidewalls facing each other; and a third holding body portion interconnecting the first and second holding body portions, the first holding body portion being connected to the perimeter wall, the second holding body portion being located away from the perimeter wall. The first holding body portion is integral with the perimeter wall. The first sidewall has a larger surface area than the second sidewall wall.

In another example, the holding body is generally triangular in longitudinally cross section.

In one example, the perimeter wall includes first and second perimeter wall sections, the first perimeter wall section being angled towards the second gap axis, the second perimeter wall section being connected to the first perimeter wall second and angled downwardly towards the floor.

In one example, the perimeter wall further includes a third perimeter wall section located at the junction between the first and second perimeter wall sections and extending around a lower portion of the holding body.

In one example, a drainage pathway is defined on either side of the holding body.

In another example, two holding bodies spaced apart and integral with the perimeter wall.

In one example, the wall panel holder includes three perimeter walls connected a together at two junctions, two of the perimeter walls being connected respectively to first and second main walls, two of the perimeter walls having two spaced apart holding bodies. Two of the holding bodies are located on either side of the junction. At least one door holding base is connected to the one of the perimeter walls and located away from the holding body, the door holding base including at least one pivot hole to receive therein a door connector of a shower door Two spaced apart door holding bases are connected the to the perimeter wall. A door gasket arranged for mating to the shower door, a door drainage channel being located between the door gasket and the floor of the shower pan.

In one example, a plurality of wall panel holders are integrally molded with the shower pan.

In another aspect, there is provided a shower stall having two wall panels and a shower door, comprising: a shower base including three perimeter walls, two of the perimeter walls including two holding bodies for holding a wall panel, each holding body including first and second spaced apart sidewalls defining a holding gap therebetween, the holding gap being sized and shaped to permit a lower portion of the wall panel to be snuggly received therein, the holding gap being located away from a perimeter wall of the shower pan so as to hold the wall panel away from the perimeter wall and to permit water to flow between the perimeter wall and under the lower portion of the wall panel.

In one example, two door holding bases are connected to one of the perimeter walls, the door holding base including two pivot hole to receive therein a door connector of the shower door. The holding bodies and the door holding bases are integrally molded with the shower base.

BRIEF DESCRIPTION OF THE DRAWINGS

Other aspects and features of the present disclosure will become apparent to those ordinarily skilled in the art upon review of the following description of specific embodiments in conjunction with the accompanying figures.

DETAILED DESCRIPTION

Figure 1:
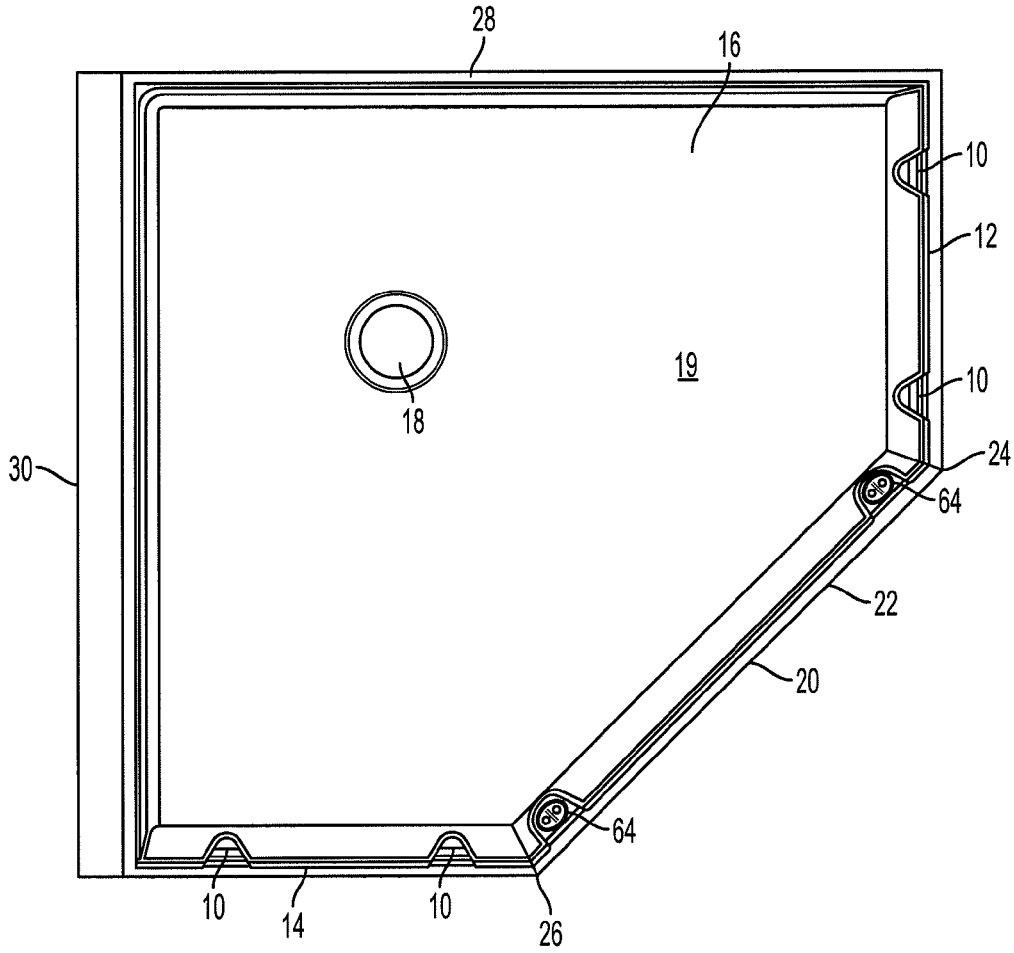
FIG. 1 is a plan view of a shower pan showing the location of a plurality of wall panel holders.

Referring now to FIG. 1, a plurality of wall panel holders are shown generally at 10. The wall panel holders 10 are integral with two perimeter sidewalls 12, 14 which are integral with a shower pan 16. The shower pan 16 includes a drain hole 18, a floor 19, and a door threshold 20, which is a perimeter sidewall 22, located between the two perimeter sidewalls 12, 14 and is connected respectively at junctions 24, 26. The perimeter sidewall 22 is angled between the other two perimeter sidewalls 12, 14, which allow the shower pan 16 and shower stall to be located in the corner of a bathroom adjacent to two main walls 28, 30 in a space efficient manner. In the example illustrated, the perimeter sidewalls 12, 14 each include two spaced apart wall panel holders. It may be possible to use at least one wall panel holder and more than two panel holders 10 depending upon the length of the perimeter wall.

The shower pan 16 is typically manufactured as a one-piece unit using techniques known to those skilled in the art. Examples of material that can be used for the pan 16 include polypropylene, sheet molding compound (SMC), urethane, or any other plastic or compound used in molding known to those skilled in the art. The main walls of a shower stall can be molded out of the same or similar material as the pan 16, or can be tile walls that are independent of the pan. Molded walls can be provided in a sheet of plastic of about 1/16" thickness, for example, and glued to walls of the shower stall. There is no gap between a molded wall and the pan/base.

Figure 2:
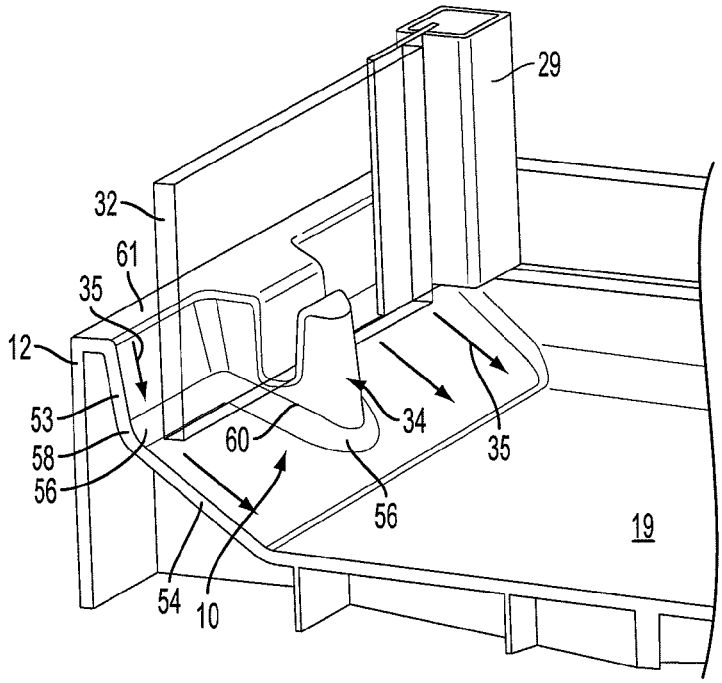
FIG. 2 is a side view, partially in cross-section, of a shower pan showing a wall panel located in a wall panel holder.

Referring now to FIGS. 2. 2A, 3 and 4, one wall panel holder 10 is illustrated with a wall panel 32 mounted therein. As the wall panel holders are all identical, only one will be described in detail. The wall panel holder 10 comprises a holding body 34 which includes including first and second spaced apart sidewalls 36, 38 defining a holding gap 40 therebetween. The holding gap 40 is generally sized and shaped to permit a lower portion 42 of the wall panel 32 to be snuggly received therein. This snug mounting is achieved without the need for screws or caulk and is, in essence, an interference fit which holds the wall panel 32 upright relative to the shower pan floor 19.

Figure 3:
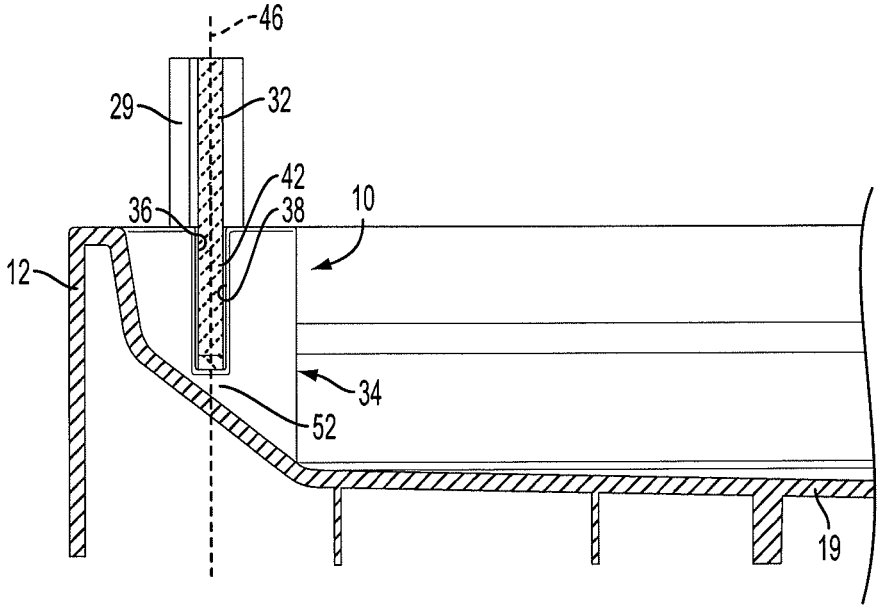
FIG. 3 is a longitudinal cross sectional view taken along line 3-3' of a wall panel holder.
Figure 4:
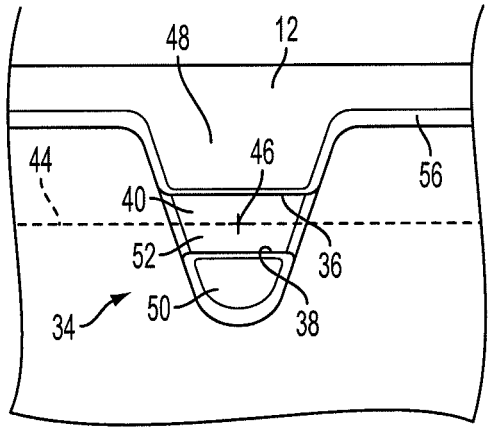
FIG. 4 is plan of a panel holding body.

Referring now to FIGS. 3 and 4, the holding gap 40 includes a first gap axis 44 disposed substantially parallel to the perimeter wall 12 and a second gap axis 46 disposed substantially orthogonal to the floor 19 of the shower pan 16 so that the wall panel 32, when secured in the holding gap 40 is held generally orthogonal to the floor 19 along the second gap axis 46. The holding body 34 includes first and second holding body portions 48, 50. Each of the body portions 48, 50 includes the respective first and second sidewalls 36, 38, which face each other. The first sidewall 36 has a larger surface area than the second sidewall 38 and when viewed in longitudinal cross section from above, the holding body 10 is generally triangular, as best seen in FIG. 4. It is to be understood, however that any shape of holding body is encompassed by this discovery. A third holding body portion 52 interconnects the two holding body portions 48, 50 along a base portion 52. The first holding body portion 48 is integrally connected to the perimeter wall 12. The second holding body portion 50 is located away from the perimeter wall 12. The holding gap 40 is located away from the perimeter wall 12 of the shower pan and projects inwardly towards the shower pan so that the wall panel 32 is held away from the perimeter wall 12, which unlike many of the conventional models where the wall panel 32 is mounted on top of the perimeter wall 12. The location of the holding gap 40 in relation to the perimeter wall 12 permits water to flow between the perimeter wall 12 and under the lower portion 42 of the wall panel 32 along a drainage pathway (or channel) 35. When the shower is in use, this permits water that may splash beyond the perimeter of the wall panel 32 to drain back into the pan and ultimately the shower drain 18.

Figure 2A:
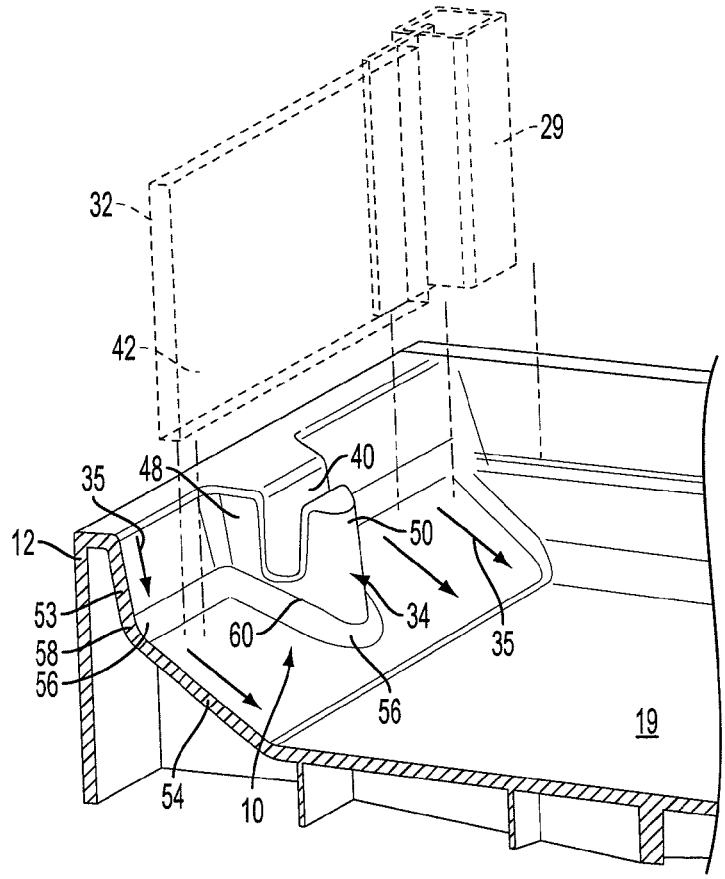
FIG. 2A is an exploded view of FIG. 2.

As best seen in FIGS. 2 and 2A, the perimeter wall 12 includes first and second perimeter wall sections 53, 54. The first perimeter wall section 53 is generally angled towards the second gap axis 46. The second perimeter wall section 54 is connected to and integral with the first perimeter wall section 53 and angled downwardly towards the floor. A third perimeter wall section 56 is located at a junction 58 between the first and second perimeter wall sections 52, 54 and extends around a lower portion 60 of the holding body 10.

As best illustrated in FIG. 1, two holding bodies 10 hold one wall panel 32. As best seen in FIG. 2, the holding body 10 holds the lower portion 42 of the wall panel 32 away from the second perimeter wall section 54 and defines the drainage pathway 35 on either side of the holding body 34 and behind the lower portion 42 of the wall panel 32. The wall panel holder 10 is sized and shaped so that there is an overlap between the lower portion 42 of the wall panel 32 and a top portion 61 of the perimeter wall 12. The wall panel holder 10 is also shaped and constructed and positioned to define the drainage pathway, or air gap, 35 between on the wall panel holder 10 and the base floor 19. The drainage channel 35 can be about 1/4 in height for ease of cleaning or about 1/8" to about 3/8" in height. When water descends, the drainage channel 35 prevents water from leaving the shower stall. In conventional shower bases where the bottom of the pan is flat at the junction where it meets the wall panel 32, water would exit the shower stall between the gap.

In operation, when water descends down the wall panel 32 and contacts the pan 16, it passes through the drainage channel 35 and does not exit the shower pan 16. In the event of a leak between the wall panel 32 and a molding 29 that holds the wall panel 32, as best illustrated in FIG. 2, against the main wall, the water travels down, pass under the wall panel 32, and continues to the drain hole 18.

Figure 5:
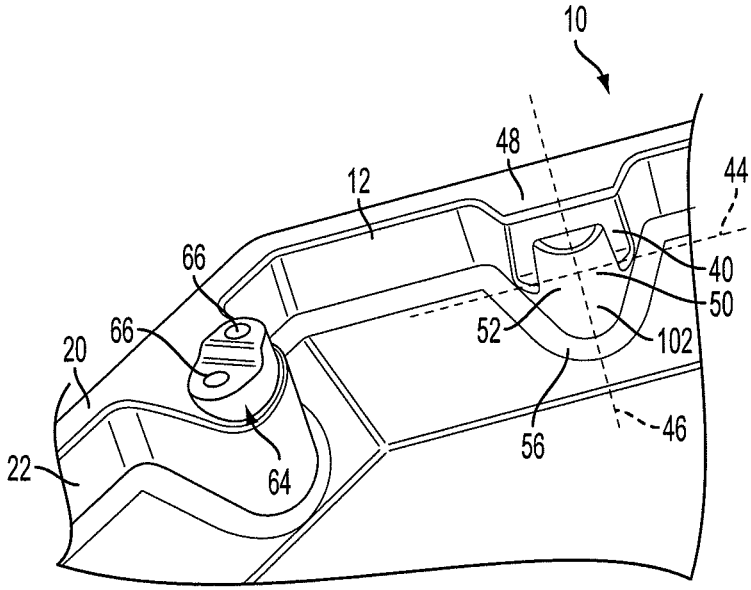
FIG. 5 is a perspective view of a portion of a perimeter wall showing the wall panel holder and a door panel holder base.
Figure 7:
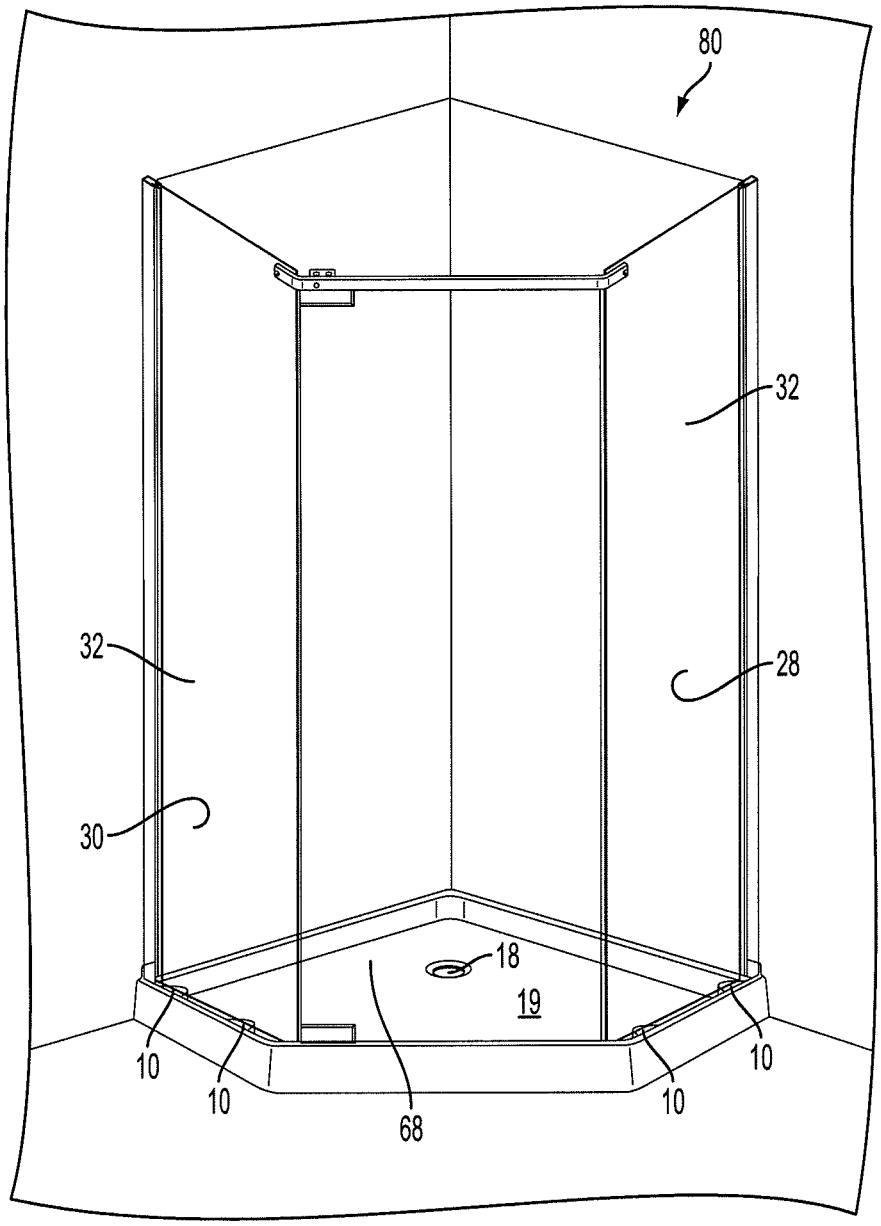
FIG. 7 is a front perspective view of a shower stall showing the wall panels and a door installed.

Referring now to FIGS. 1, 5, and 7, at least one door holding base 64 is connected the perimeter wall 22 and located away from the holding body 10. The door holding base 64 includes at least one pivot hole 66 to receive therein a door connector (not shown) of a shower door 68 In the example illustrated, two spaced apart door holding bases 64 are connected the to the perimeter wall 22 and permit doors of different sizes to be used with the same door holding base. Similarly, two pivot holes 66 are typically used in the same holding base 64 to permit different door sizes to be used. Also, this permits the mounted door 68 to open in either direction. Since the same base can be used for different shower models, the two holes are for holding the door of one model or the other. The door holding base 64 can be provided on both sides, to enable reversible installation of the door.

Figure 6:
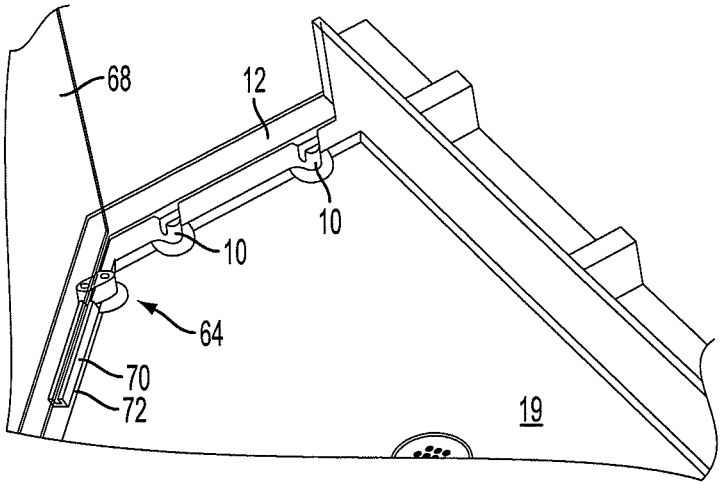
FIG. 6 is a top partial perspective view of the shower pan showing the location of a gasket.

Referring to FIG. 6, a door gasket 70 is arranged for mating to the shower door 68 and is located under the door 68 and defines a door drainage pathway (or channel) 72 between the gasket 70 and the floor 19 of the shower pan 16. The drainage channel 72 provides an advantage with respect to water circulation. Water pressure can be high enough that even if the molding 29 is screwed to the wall, a silicone joint is required. Sometimes it is between the wall panel 32 and the aluminum molding 29 that water passes. Thus, the water ends up on the outside of the wall panel 32. The door gasket 70 is positioned such that it does not touch the floor 19. The door gasket 70 can have an inverted V shape. The door gasket 70 does not touch the door threshold 20, so that water can pass between the gasket 70 and the threshold 20, which is the internal bar on the inner periphery or the outer edge of the base 16. As such, the door gasket 70 defines the door drainage channel 72, similar to the drainage channel 35 described above in relation to the wall panel 32.

In conventional shower bases, a wall panel gasket is located under the door and touches the base to ensure that water cannot exit. In our design, there is no wall panel gasket used with the wall panels, which are snuggly held in the wall panel holders.

If a door opening to the interior of the shower stall is used, and the door 68 has sufficient length, the door gasket can be omitted entirely. This can be advantageous in larger shower stalls. Many smaller size shower stalls use doors that open in an outward manner with respect to the shower stall.

Referring now to FIG. 7, a shower stall 80 is shown installed against the two main walls 28, 30 in the corner of a bathroom with two wall panels 32 located on either side of the door 68 and held in place by the holding bodies 10. The door 68 is located opposite the shower head (not shown), with the wall panels 32 and the door 68 enclosing the shower pan 16 in a seal-less manner.

The above-described embodiments are intended to be examples only. Alterations, modifications and variations can be effected to the particular embodiments by those of skill in the art without departing from the scope of the disclosure, which is defined solely by the claims appended hereto.

We claim:

1. A wall panel holder for a shower pan having a floor, comprising:

a holding body including first and second spaced apart sidewalls defining a holding gap therebetween, the holding gap being sized and shaped to permit a lower portion of a wall panel to be snuggly received therein, the holding gap being located away from a perimeter wall of the shower pan so as to hold the wall panel away from the perimeter wall and to permit water to flow between the perimeter wall and under the lower portion of the wall panel, the perimeter wall being angled downwardly towards the floor, wherein the holding gap has a first gap axis disposed parallel to the perimeter wall and a second gap axis disposed orthogonal to the floor, the wall panel being held in the holding gap orthogonal to the floor along the second gap axis, and further wherein the perimeter wall includes first and second perimeter wall sections, the first perimeter wall section being angled towards the second gap axis, the second perimeter wall section being connected to the first perimeter wall section, the second perimeter wall section being angled downwardly towards the floor.

2. The wall panel holder, according to claim 1, in which the holding body includes:

first and second holding body portions, each body portion including the respective first and second sidewalls, the sidewalls facing each other; and a third holding body portion interconnecting the first and second holding body portions, the first holding body portion being connected to the perimeter wall, the second holding body portion being located away from the perimeter wall.

3. The wall panel holder, according to claim 2, in which the first holding body portion is integral with the perimeter wall.

4. The wall panel holder, according to claim 2, in which the first sidewall has a larger surface area than the second sidewall wall.

5. The wall panel holder, according to claim 1, in which the holding body is triangular in longitudinally cross section.

6. The wall panel holder, according to claim 1, in which the perimeter wall further includes a third perimeter wall section located at the junction between the first and second perimeter wall sections and extending around a lower portion of the holding body.

7. The wall panel holder, according to claim 1, includes a drainage pathway located on either side of the holding body.

8. The wall panel holder, according to claim 1, includes two holding bodies spaced apart and integral with the perimeter wall.

9. The wall panel holder, according to claim 1, includes three perimeter walls connected together at two junctions, two of the perimeter walls being connected respectively to first and second main walls, two of the perimeter walls having two spaced apart holding bodies.

10. The wall panel holder, according to claim 9, in which two of the holding bodies are located on either side of the junctions.

11. The wall panel holder, according to claim 9, in which at least one door holding base is connected to the one of the perimeter walls and located away from the holding body, the door holding base including at least one pivot hole.

12. The wall panel holder, according to claim 11, two spaced apart door holding bases are connected the to the perimeter wall.

13. The wall panel holder, according to claim 11, in which a door gasket arranged for mating to the shower door, a door drainage channel being located between the door gasket and the floor of the shower pan.

14. The wall panel holder, according to claim 1, in which a plurality of wall panel holders are integrally molded with the shower pan.

15. A shower stall having two wall panels and a shower door, comprising:

a shower base including three perimeter walls and a floor, two of the perimeter walls including two holding bodies for holding a wall panel, each holding body including first and second spaced apart sidewalls defining a holding gap therebetween, the holding gap being sized and shaped to permit a lower portion of the wall panel to be snuggly received therein, the holding gap being located away from one of the perimeter walls of the shower base so as to hold the wall panel away from the perimeter wall and to permit water to flow between the perimeter wall and under the lower portion of the wall panel, the perimeter wall being angled downwardly towards the floor, wherein the holding gap has a first gap axis disposed parallel to the perimeter wall and a second gap axis disposed orthogonal to the floor, the wall panel being held in the holding gap orthogonal to the floor along the second gap axis, and further wherein the perimeter wall includes first and second perimeter wall sections, the first perimeter wall section being angled towards the second gap axis, the second perimeter wall section being connected to the first perimeter wall section, the second perimeter wall section being angled downwardly towards the floor.

16. The shower stall, according to claim 15, in which two door holding bases are connected to one of the perimeter walls, the door holding base including two pivot holes.

17. The shower stall, according to claim 15, in which the holding bodies and the door holding bases are integrally molded with the shower base.

* * * * *